US010227219B2

(12) United States Patent
Awi Abalo et al.

(10) Patent No.: US 10,227,219 B2
(45) Date of Patent: Mar. 12, 2019

(54) RAIL FOR CRANE BOOM HINGE

(71) Applicant: HF HOLDING SA, Nivelles (BE)

(72) Inventors: Bolom Awi Abalo, Vilvoorde (BE); Michel Lens, Beersel (BE)

(73) Assignee: HF Holdiing SA, Nivelles (BE)

( * ) Notice: Subject to any disclaimer, the term of this patent is extended or adjusted under 35 U.S.C. 154(b) by 396 days.

(21) Appl. No.: 14/904,522

(22) PCT Filed: Jul. 8, 2014

(86) PCT No.: PCT/EP2014/064654
§ 371 (c)(1),
(2) Date: Jan. 12, 2016

(87) PCT Pub. No.: WO2015/004160
PCT Pub. Date: Jan. 15, 2015

(65) Prior Publication Data

US 2016/0159618 A1 Jun. 9, 2016

(30) Foreign Application Priority Data

Jul. 12, 2013 (EP) ..... 13176372

(51) Int. Cl.

| | |
|---|---|
| ***B66C 7/08*** | (2006.01) |
| ***E01B 5/08*** | (2006.01) |
| ***B66C 19/00*** | (2006.01) |
| *E01B 19/00* | (2006.01) |

(52) U.S. Cl.
CPC ..... *B66C 7/08* (2013.01); *B66C 19/002* (2013.01); *E01B 5/08* (2013.01); *E01B 19/00* (2013.01)

(58) Field of Classification Search
CPC ..... E01B 9/62; E01B 9/68; E01B 19/003
See application file for complete search history.

(56) References Cited

U.S. PATENT DOCUMENTS 6,402,044 B1 * 6/2002 Sato ..... E01B 5/08 238/382
2011/0180506 A1 * 7/2011 Lerchenmuller ..... B66C 9/16 212/276

FOREIGN PATENT DOCUMENTS

| | | | |
|---|---|---|---|
| DE | 4007937 | A1 | 9/1991 |
| EP | 2390411 | A1 | 11/2011 |
| FR | 2814477 | A1 | 3/2002 |
| FR | 2890988 | A1 | 3/2007 |
| KR | 20000073654 | A | 12/2000 |

* cited by examiner

*Primary Examiner* — Robert J McCarry, Jr.
(74) *Attorney, Agent, or Firm* — Reinhart Boerner Van Deuren P.C.

(57) ABSTRACT

Rail (10, 30) for use at boom hinges (5) of a crane (1), extending longitudinally from one end (11) to an opposite end (12), comprising a rail head (13, 33) having a running surface (131) for a wheel of a railway vehicle, a rail foot (14, 18, 38) for fastening the rail, and a web (15) connecting the rail head to the rail foot and interposed between the rail head and the rail foot, wherein the rail head is continuous along the length of the rail. The rail comprises a resilient member (16, 36) extending across the web (15) from the one end (11) of the rail over a length shorter than the length of the rail in order to provide a resiliency of the rail head (13, 33) relative to the rail foot (18, 38) over a length of extension of the resilient member.

20 Claims, 10 Drawing Sheets

RAIL FOR CRANE BOOM HINGE

The present invention is related to rails, in particular rail bars or beams, which comprise a resiliency in order to absorb shocks. The present invention is particularly related to rails for use on cranes having pivoting booms.

Fastening systems for crane rails must be able to resist very high loads per wheel and provide a suitable response to fatigue phenomena related to the cyclic character of the loads. The fastening method that has been imposed by the market is based on a very simple principle. It aims at allowing enough freedom of vertical and rotational movement of the rail so that it can adjust to the wheels of the crane and avoid local constraints while maintaining the rail firmly in place with regard to lateral movement; hence the name "soft mounting". Other solutions that keep the rail too rigidly are prone to failure as significant forces are passed directly through these bindings, hence resulting in a loosening of joints, breaking of welds and bolts, etc. The currently most common soft mounting for rails is formed of a continuous band of soft rubber called rail pad, on which the rail rests, and clips regularly arranged along the rail for securing the rail to the foundation. The clips lock the lateral movement of the rail while still allowing a limited vertical movement. This attenuated vertical clamping is further obtained by providing a rubber strip between the clip and the rail foot, in addition to the rail pad. This solution is particularly suitable when the load exceeds a certain level, and when the crane has a particularly high usage rate, such as for automated stacking cranes operating continuously.

Typical container handling cranes, such as at ports, are equipped with pivoting booms, which extend from a fixed girder to span the width of the ship. Such a known crane 1 is depicted in FIG. 1 and described in Korean patent application publication No. 10-2000-0073654. The boom 4 pivots about a hinge 5 between boom 4 and girder 3 in order to allow passage of the ship cabin 8 underneath. The girder 3 is fixed on the frame 2 of the crane 1. A container handling trolley 6 is able to run on rails provided on the boom 4 and which continue on the girder 3 in order to be able to move containers 7 between ship 9 and shore. At the junction (hinge) 5 between boom 4 and girder 3 of the crane 1, there is a break in continuity of the rail in order to enable the boom 4 to pivot. Clearly, the alignment of the running surface of the rail at the junction discontinuity is of a major concern. A staircase of a few tenths of a millimeter can already cause a major shock to the container handling trolley. Indeed, at the rail junction, the trolley moves typically at 200 m/min (12 km/h), following a very strong acceleration, and the load per wheel of the trolley can reach 40 tonnes when full containers are conveyed. Under usual operating conditions, the trolley passes the rail junction once every minute to two minutes. It is evident that these high impact loads are passed to the rail fasteners at the junction between boom and girder. Even the operator in the crane cabin feels the shocks, which cause such a discomfort in the cabin that the operator's work shift is often limited to between 2 and 3 hours before a break or an operator change.

Progress has been made in crane construction in order to reduce play at the pivot and hence increase positioning repeatability of the beam after every pivoting motion. Additionally, solutions have been implemented, in which the rail discontinuity follows a specific shape across the rail, such as obliquely to the direction of motion or L-shaped, in order to provide a progressive transition of the load of the railway vehicle wheel from the rail on the girder to the rail on the boom and vice versa. However, it is inherent in such large and heavy constructions that play and hence loss of rail alignment will occur over time. The loss of alignment is caused by several factors: the appearance of play in the hinge of the boom, wear of the boom supports on the frame of the crane, thermal expansion, a flexible boom and/or frame. This loss of alignment creates a vertical staircase at the rail junction between the girder and the boom. Any staircase of the running surface at the rail discontinuity will cause the rail to be subjected to a longitudinal shock force at the passage of a trolley wheel. The rail soft clamping as described above is not able to suitably withstand such longitudinal loads. It is for this reason that at both sides of the boom pivot 5, the rail is clamped rigidly to the crane's frame structure over a length of about one meter at each side of the junction. The conventional rail clamping (soft mounting) with rail pad and clips is provided beyond.

An example rail mounting of the above type is described in KR 10-2000-0073654. In proximity of the junction, the rail pad is removed and metal shims are used in order to adjust the height of the rail ends at the discontinuity. These shims are provided on a steel pad welded to boom or girder and the rail is firmly fastened thereon. It is also known to grind or polish the running surface of the rail at the joint in order to remove any further deviation. This part of the rail is called "short rail". The short rail bar may also be machined out of a block of high resistance steel.

The lifetime of the above described short rail assembly is usually about 5 years but reduces to only a few months in presence of large shocks due to alignment problems between the boom and the girder of the crane. Indeed, due to the rigidity of the assembly, even the slightest alignment error causes high stresses at the fasteners when a trolley wheel passes. Bringing the short rail back to operating conditions can take up to five days, during which the crane is immobilized.

On the other hand, a rail assembly is known from DE 4007937, wherein a rail is clamped in a frame through elastic layers arranged sideways of the web, between rail head and rail foot. The elastic mounting extends along the entire length of the rail and reduces structure-borne noise. Such an arrangement however results to be a mere alternative to the soft mounting of crane railways, and cannot overcome the above described problems at the rail discontinuity.

There is hence a need in the art of an improved solution for the short rail assembly in cranes with pivoting booms. It is hence an aim of the invention to provide a rail and a rail assembly which overcomes the above problems, and particularly which improves the rail assembly's lifetime at the junction between boom and girder, and/or reduces the effects of shocks due to possible alignment problems at the rail discontinuity and hence reduces maintenance.

According to aspects of the invention, there is therefore provided a rail as described in the appended claims. A rail is provided for use at boom hinges of a crane, which rail extends longitudinally from one end to an opposite end of the rail. The rail comprises a rail head having a running surface for a wheel of a railway vehicle, a rail foot for fastening the rail, and a web connecting the rail head to the rail foot and interposed between the rail head and the rail foot. The rail head is continuous along the length of the rail.

According to the invention, the rail comprises a resilient member extending across the web and from the one end of the rail over a length shorter than the length of the rail, in order to provide a resiliency of the rail head relative to the rail foot over a length of extension of the resilient member.

The resilient member advantageously acts as a shock absorber to dampen shocks caused by railway vehicle wheels passing over the rail discontinuity at the hinge junction. This damping effect allows the energy borne from the shocks to dissipate. This in turn reduces the stresses in the rail fasteners. As a result, there is a reduced risk of loosening of the fasteners, and of fatigue in the nuts and bolts, and the welds.

Importantly, by providing the resilient member through the rail itself, it is obtained that the rail foot can be firmly clamped according to conventional methods, while the rail head maintains a resiliency able to absorb or at least dampen shocks. Rails according to the invention can therefore be used without any change to current rail fastening techniques, yet allow for extending the advantages of a soft mounting up to the rail discontinuity. Moreover, by providing the resilient member in the "heart" of the rail, there will be a reduced transmission of shock loads to the fasteners, which will consequently be less subjected to stresses. As a result, crane maintenance will be facilitated, by simple replacement of worn parts without the need for repairs. The immobilization of the crane would thus be greatly reduced.

Yet another advantage of rails according to the invention, is that they can be made from same rail bars used for the other sections of the railway track, hence ensuring a perfect continuity.

According to aspects of the invention, there is provided a rail assembly, and a crane incorporating the rail assembly as set out in the appended claims.

Advantageous aspects of the present invention are set out in the dependent claims.

Aspects of the invention will now be described in more detail with reference to the appended drawings, which are illustrative only and wherein same reference numerals illustrate same features and wherein.

Figure 1:
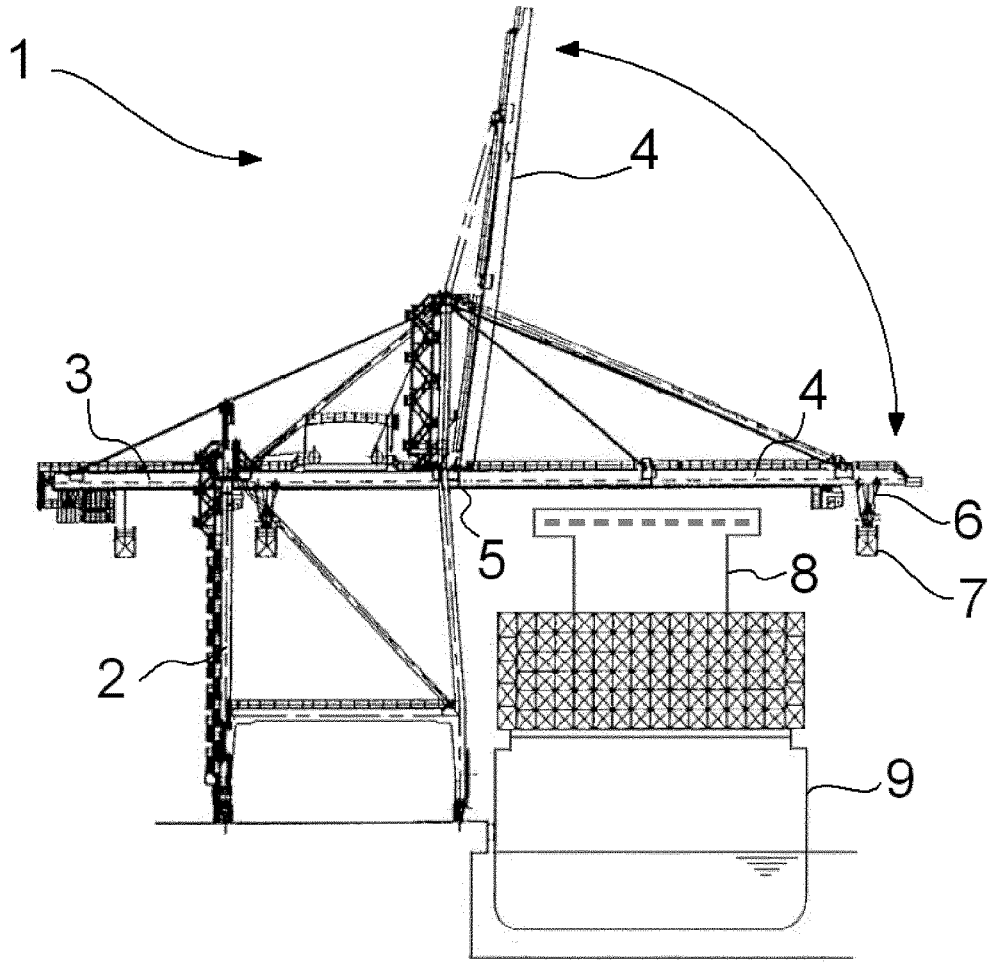
FIG 1 (PRIOR ART)
FIG. 1 represents a known crane with pivoting boom for (un)loading containers.
Figure 2:
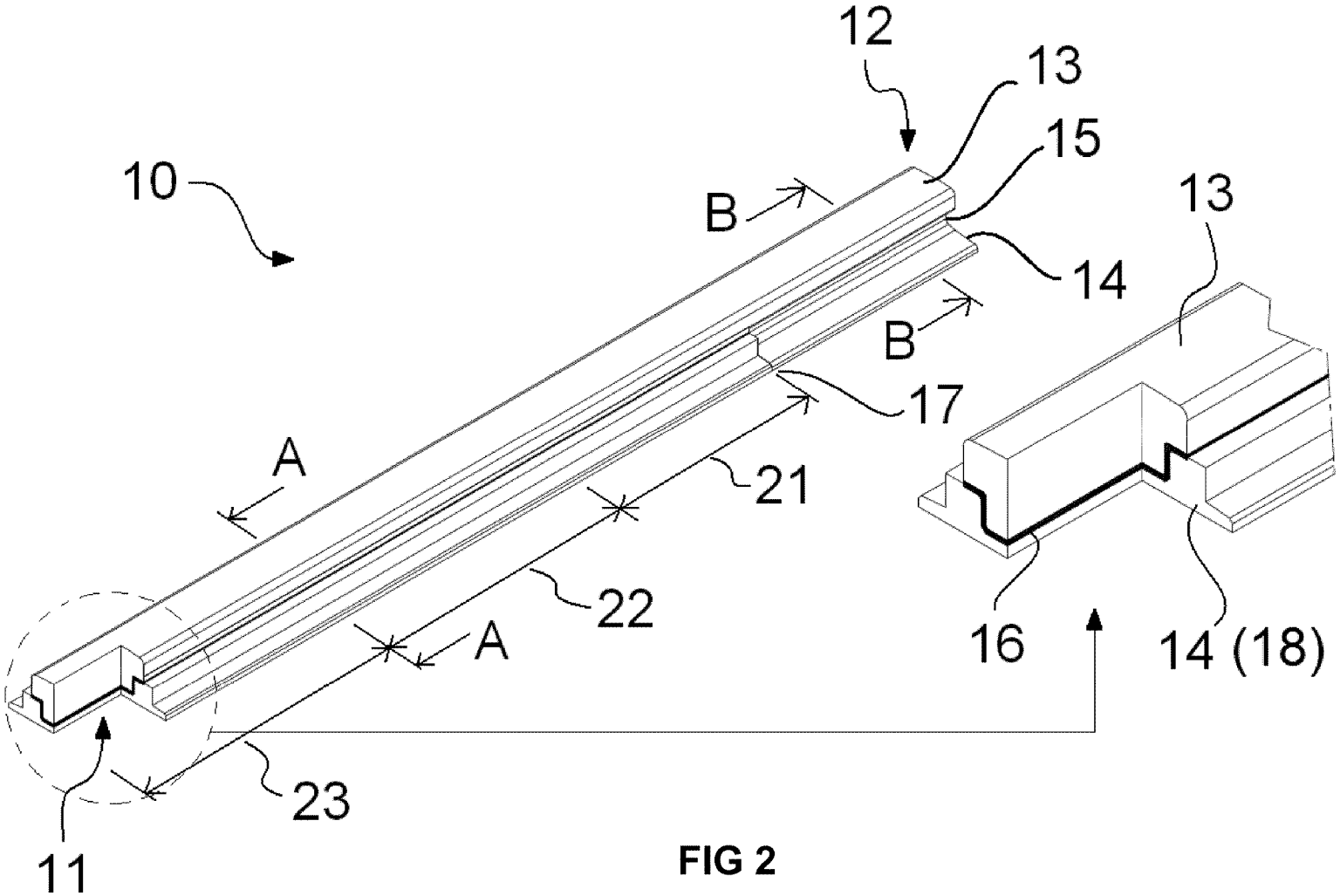
FIG. 2 represents a perspective view of a rail according to an aspect of the invention.
Figure 3:
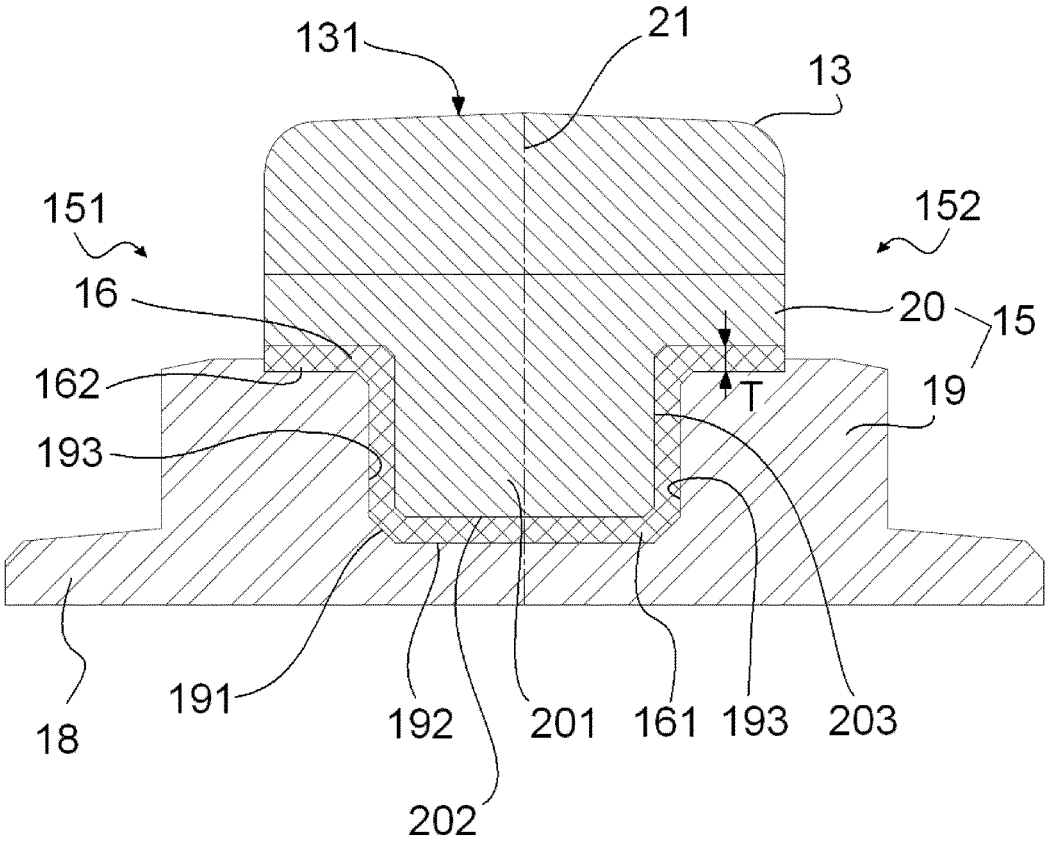
FIG. 3 represents a cross sectional view along line A-A of the rail shown in FIG. 2.
Figure 4:
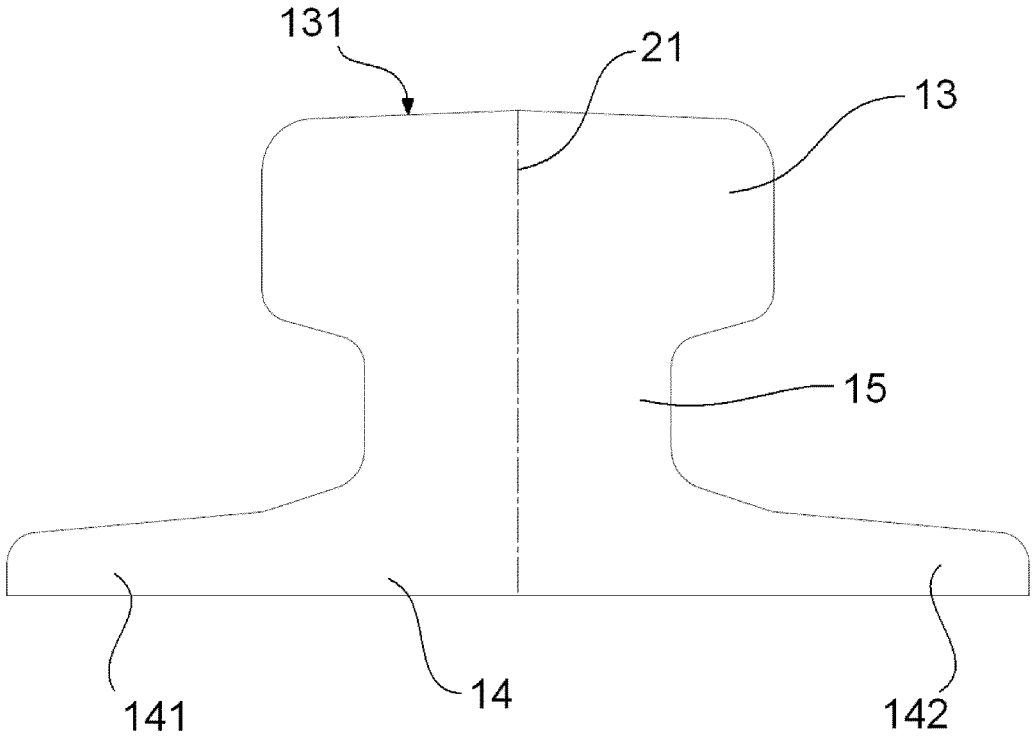
FIG. 4 represents a cross sectional view along line B-B of the rail shown in FIG. 2.
Figure 5:
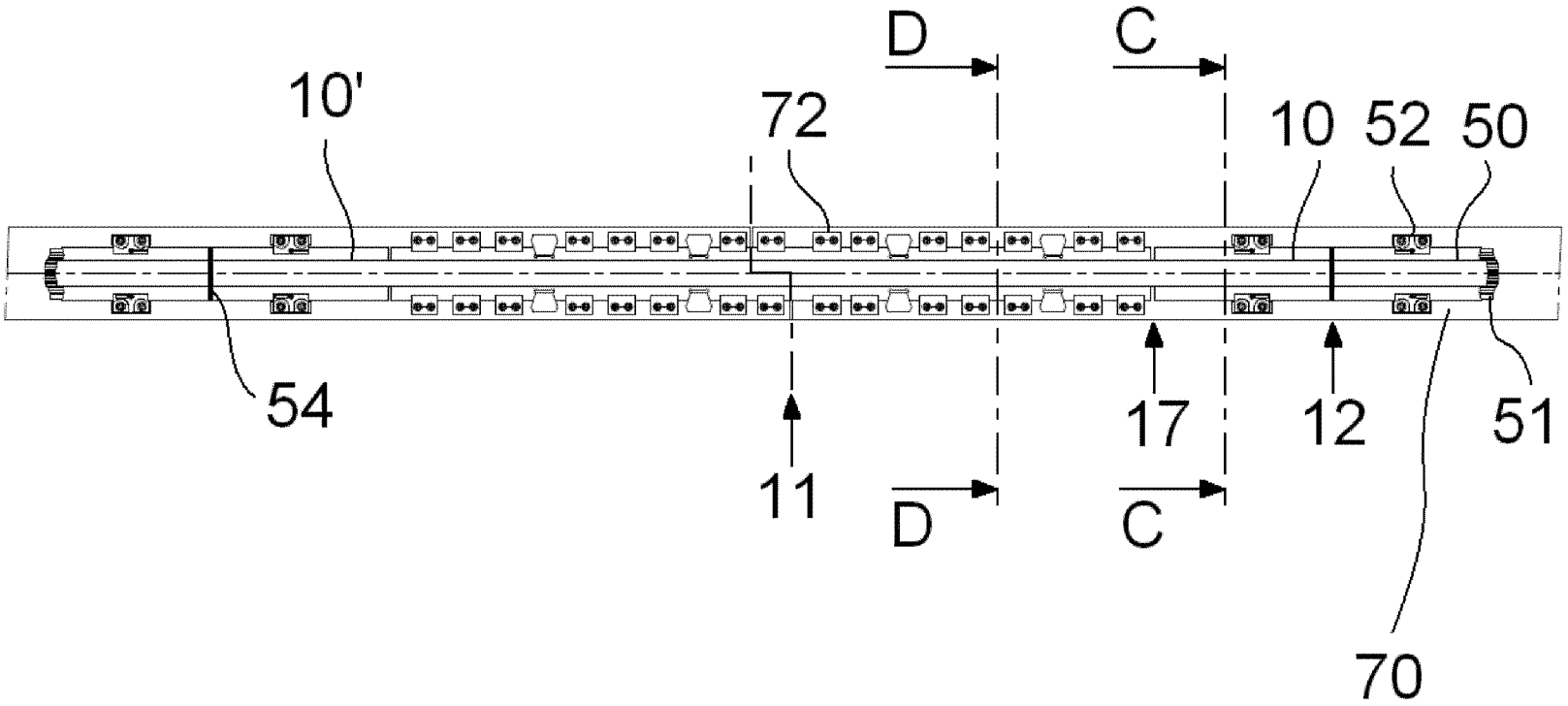
FIG. 5 represents a top view of a layout of a rail assembly according to aspects of the invention at a hinge of a crane boom.

Referring to FIGS. 2-4, a rail 10, also referred to as rail bar, or short rail, extends from one longitudinal end 11 to the opposite end 12. End 11 will be arranged at the junction 5 between girder 3 and boom 4 of a crane 1, and in fact forms the discontinuity between the rail 10' of the girder 3 and the rail 10 of the boom 4 as shown in FIG. 5. The rail 10 is cut at end 11 according to any suitable shape, such as an L-shape as shown in FIG. 2. A rail 10' with correspondingly shaped end is provided at the other side of the junction 5 as shown in FIG. 5.

Rail 10 comprises a rail head 13, rail foot 14 and a web 15 connecting the head to the foot. An upper surface 131 of rail head 13 acts as a running surface for the wheels of a railway vehicle, such as a crane container handling trolley 6. Typically, rail foot 14 has a flanged shape with flanges 141, 142 extending along either side of the web 15. Web 15 can have any suitable shape. It will be convenient to note that web 15 need not be slender, nor have a constant cross section between rail head and foot. The term web generally refers to any structure interposed between the rail head and the rail foot and arranged for maintaining the rail head at a predetermined distance from the rail foot and connecting the two.

According to the invention, the web 15 is crossed by a resilient member 16, along only a part of the length of the rail 10. Resilient member 16 extends across the web 15, from one lateral end to the opposite lateral end of the web, thereby separating the rail head 13 from the rail foot 14 from end 11 to an intermediate location 17 between rail ends 11 and 12.

Between end 11 and the intermediate location 17, the rail head 13 is connected to the rail foot through the resilient member 16. As a result, in the region 11-17 the resilient member provides a resiliency to the rail head 13 relative to the rail foot 14 according to at least one degree of freedom, and advantageously for lateral, vertical and rotational (about longitudinal axis) movements. It will be convenient to note that, in the region between the intermediate location 17 and the opposite end 12, this resiliency is absent in the rail. The intermediate location 17 in fact forms the transition between the resilient part of the rail 10 (region 11-17) and the rigid part of the rail (region 17-12). In this regard, FIG. 3 shows the cross section of the rail 10 in the resilient region 11-17, whereas FIG. 4 shows the cross section of that same rail 10 in the rigid region 17-12. It will be convenient to note that the rigid region of the rail (region 17-12) is advantageously characterised by a rigid connection between rail head 13 and rail foot 14, i.e. the web 15 is rigidly secured to, and is advantageously formed integral with, the head and the foot of the rail.

The use of the rail 10 will become evident with reference to FIG. 5, which shows the layout at the boom hinge of a crane. At both sides of the hinge junction (corresponding to position 11), a symmetrical configuration of a rail assembly is provided. Rail 10 is provided on the right-hand side of the junction, corresponding to the side of either the pivoting boom or the (fixed) girder. An identical rail 10' is provided at the other side. End 11 of either rails is correspondingly L-shaped. At end 12, the rail 10 is welded to another rail 50 through a weld seam 54 hence providing for a continuity of the railway track.

Figure 6:
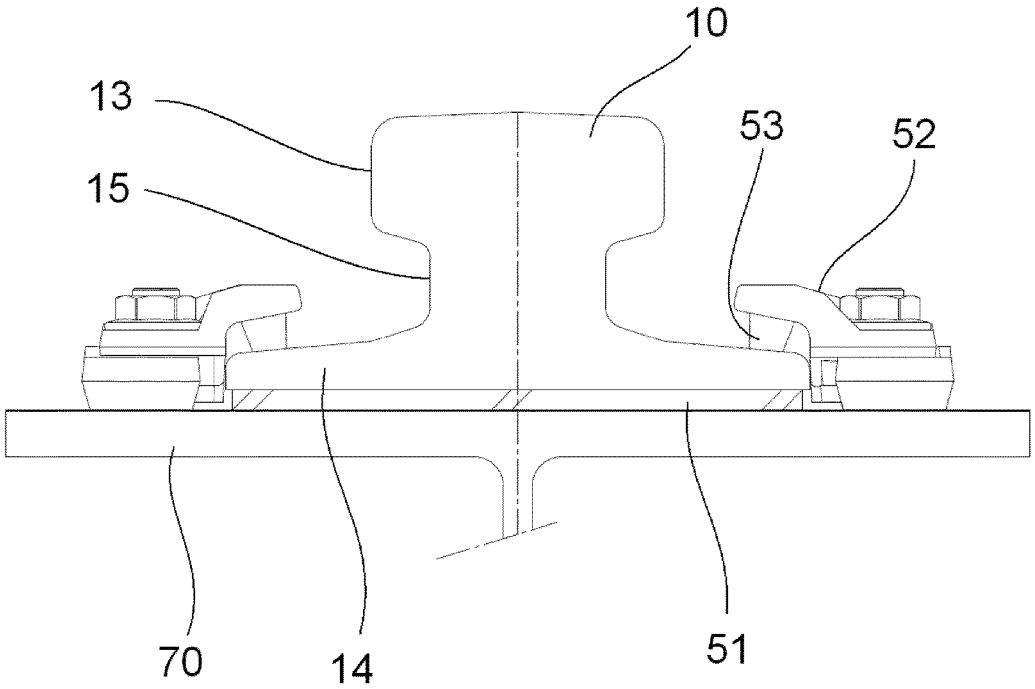
FIG. 6 represents a cross sectional view along line C-C of the assembly of FIG. 5.

Rail 50, as well as the rigid region 17-12 of rail 10 is secured to the crane through a soft mounting system as discussed above and shown in FIG. 6. Hence, a resilient pad 51 is provided underneath the rail, extending up to intermediate location 17. Rail clips 52 with resilient strips 53 as are known in the art are used for fastening the rail to the support 70.

Figure 7:
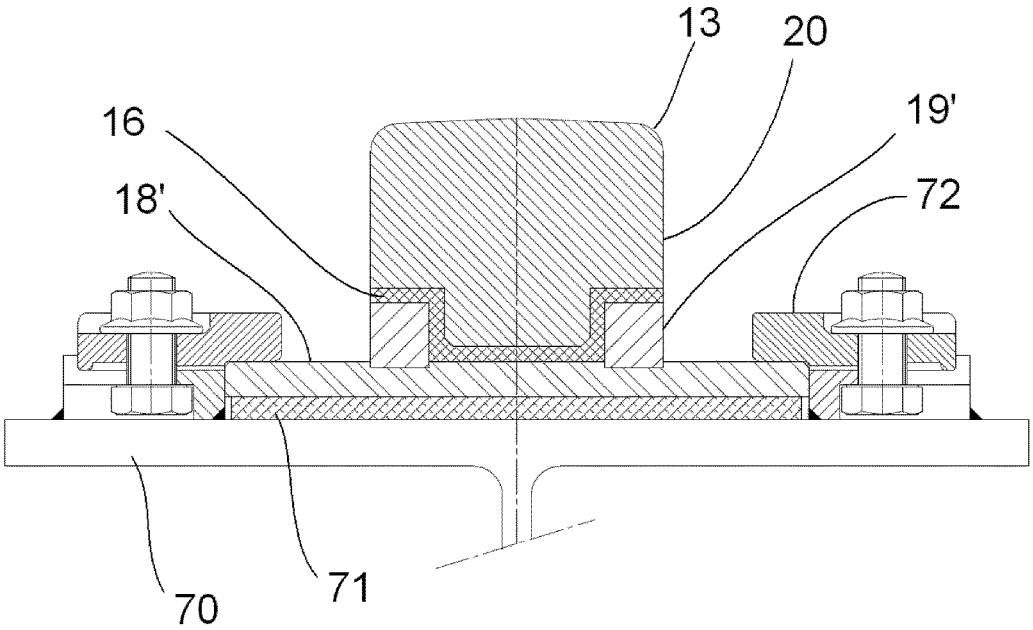
FIG. 7 represents a cross sectional view along line D-D of the assembly of FIG. 5.

In the resilient region of the rail 10, between intermediate location 17 and end 11, the fastening assembly is different, as shown in FIG. 7. Here, a steel shim 71 is provided underneath the rail 10 instead of the resilient pad 51. The rail is fastened through clamps 72, which provide for a rigid securement of the rail on the rigid support 70, which can be steel or cast epoxy. In this region, according to the invention, a load exerted by a railway vehicle wheel on the rail head 13, is transferred to the rail foot 18' through the resilient member 16.

Since it is practically impossible to match the resiliency of the resilient member 16 to that of the rail pad 51, the rail head 13 is made continuous at the transition at the intermediate location 17. This avoids shocks by the railway vehicle wheels at the intermediate location.

A rail 10 according to the invention can be manufactured starting from a usual rail 50, with continuous cross section as shown in FIG. 4. After having determined the region 11-17 where the resilient member 16 needs to be inserted, the rail foot 14 and the web 15 is cut out in that region, hence retaining only the rail head 13. Referring to FIG. 3, for the resilient region 11-17, a dedicated rail foot 18 and web members 19, 20 are provided, which can be manufactured according to known techniques, such as by machining from conventional materials, such as steel.

The web in the resilient region 11-17 of rail 10 hence comprises a lower web member 19, which is rigidly secured to, and advantageously integrally formed with, the rail foot 18, and a corresponding upper web member 20 which is rigidly secured to the rail head 13, such as by welding. The resilient member 16 is interposed between the lower web member 19 and the upper member 20. It will be convenient to note that other ways of manufacturing are possible. By way of example, the upper web member 20 can be machined from the original web 15, so as to be integrally formed with the rail head 13. In the example embodiment of FIG. 7, the rail foot 18' is formed of a steel plate and the lower web member 19' is formed of two steel bars secured on the plate.

To form the resilient member 16, an overmolding process is advantageously used. Overmolding refers to the molding of one material (the material forming the resilient member 16) over another material (the steel foot and head parts). If properly selected, the overmolding material will form a strong bond with the material over which it is moulded, which bond is maintained in the end-use environment. Use of adhesives is no longer required. To this end, the rail 10, with rail head 13, foot 18 and web members 19, 20 is placed in a mould, such that the foot part 18, 19 assumes a desired relative position with regard to the head part 13, 20 and the location of the resilient member 16 is void. The void between the head part and the foot part is filled with a monomeric resin. The resin can be polymerised (vulcanized) afterwards, such as in an oven, or even in a mould, at elevated temperature and pressure, such that a high accuracy and good adherence is obtained. Alternatively, it is possible to pre-form the resilient member, such as by extrusion, from a monomeric resin. The different components, viz. head part, foot part and resilient member are then assembled, such as in a mould. The resilient member is subsequently polymerised to obtain a homogeneous resilient member, strongly adhering to the steel of foot and head parts.

The shape of the resilient member 16 can be selected in relation to the direction of the loads on the rail. Advantageously, the shape of the resilient member 16 is such that it allows transferring both vertical and transverse loads exerted on the rail head 13 to the rail foot 18 through the resilient member 16.

Referring to FIGS. 3 and 7, the resilient member 16 has advantageously a U-shaped, or upward C-shaped cross section. The lower web member 19 therefore comprises a longitudinally extending recess 191, having an advantageously substantially flat bottom 192 and advantageously upright walls 193. The upper web member 20 comprises a downwards projection 201 extending into recess 191, with an advantageously flat bottom surface 202 and advantageously upright walls 203. The resilient member 16 hence forms a layer following the shape of recess 191, and extends both throughout the bottom 192 and along the walls 193. The bottom surface 192 of recess 191 supports the upper web member 20 and hence the rail head 13, whereas the walls 193 form abutments taking up lateral loads exerted on the rail head 13. The resilient member 16 has a thickness bridging the gap between the bottom 192 of the recess and the bottom surface 202 of the projection 201, and between the walls 193 of the recess and the walls 203 of the projection. As a result, the resilient member effectively acts as a shock absorber and damper for both vertical and lateral loads exerted on the rail head, before such loads are transmitted to the rail foot 18 and hence the clamping means.

Advantageously, the resilient member 16 comprises edge lips 162 at the upper ends of the U-shape 161. Edge lips 162 extend substantially horizontally laterally of the U-shape section 161 and provide increased support for the rail head 13 and possibly a better support for rotational deflections of the rail head about a longitudinal axis (torsion).

A U-shaped cross section advantageously allows for meeting requirements related to all the stresses typically encountered at the hinge junction:

- shocks generated by the wheels due to alignment defects at the rail discontinuity at the hinge junction, both vertically and horizontally, will be attenuated by a slight movement of the rail head relative to the rail foot, possible in all directions (vertical, horizontal, and by rotation about a longitudinal axis);
- vertically, the resilient member 16 acts similarly as the rail pad 51, by spreading the vertical loads caused by the railway vehicle wheel over a greater length, referred to as effective length;
- horizontally and laterally, the resilient member 16 acts as a resilient abutment for transverse loads, such as exerted by the wheel guide flanges, e.g. due to play in the wheels, or, importantly, by horizontal guide rollers, which are generally placed at a distance from the (vertical) wheels and which are difficult to align correctly against the rail: since they are offset relative to the wheels, they induce a rotation of the rail about a longitudinal axis;
- horizontally and longitudinally, the elasticity of the resilient member enables to distribute loads due to acceleration or braking of the railway vehicle over larger effective lengths, hence reducing stresses on the rail fasteners to acceptable levels; and
- if the wheel is eccentric, the rail head is able to rotate slightly without transmitting undue stresses to the fasteners, leading to a reduced risk of fasteners loosening or welds breaking due to fatigue stresses.

This is advantageously obtained by the resilient member extending in a substantially horizontal plane between rail head and rail foot (the bottom 192 of recess 191), and in one or more substantially vertical planes between rail head and rail foot (the upright walls 193 of recess 191).

The length over which the resilient member 16 is made to extend, and hence the length of the resilient region 11-17, is advantageously at least 0.1 m, advantageously at least 0.25 m, advantageously at least 0.4 m, and advantageously not larger than 3 m, advantageously not larger than 2.5 m, advantageously not larger than 2 m.

The resilient member has a thickness T of at least 1.5 mm, advantageously at least 2 mm, advantageously at least 2.5 mm, and advantageously smaller than or equal to 20 mm, advantageously smaller than or equal to 15 mm, advantageously smaller than or equal to 10 mm over the majority of its extent (at least 51%, advantageously at least 75% of its length).

The rail bar or short rail 10 according to the invention has a length advantageously falling in the range between 0.5 m and 6 m.

The resilient member 16 is made of a resiliently compressible material, advantageously made of a vulcanized polymer, advantageously rubber, which can be natural rubber, or synthetic rubber. An advantageous material is (poly) chloroprene (CR), since it has a highly durable elastic behaviour. Less suitable materials for the resilient member are thermohardening resins, such as polyurethane, and silicone materials.

The material of resilient member 16 advantageously conforms to the material characteristics set out in French standard NF L17-131:2011, for any of classes 31B5 to 31B9.

The material of resilient member 16 advantageously exhibits an international rubber hardness degree (IRHD, following ISO 48) of at least 40 in its initial state, advantageously at least 45. The IRHD advantageously is smaller than or equal to 100, advantageously smaller than or equal to 95.

The material of resilient member 16 advantageously exhibits a Shore A hardness of at least 40 in its initial state, advantageously at least 45. The shore A hardness advantageously is smaller than or equal to 100, advantageously smaller than or equal to 95. Shore A hardness can be measured according to ISO 7619-1, with indentation measured after 3 s.

The material of resilient member 16 advantageously exhibits an elongation at break of at least 200%.

Advantageously, the rail head 13 has a resiliency relative to the rail foot 18 which varies between the intermediate location 17 and the rail end 11. Advantageously, the resiliency is reduced towards the rail end 11. In other words, the stiffness between rail head 13 and rail foot 18 is increased from the intermediate location 17 towards the rail end 11, the increase being advantageously made progressive. This allows for providing a gradual transition in behaviour of the rail, between the rail pad, which typically allows a vertical compressibility on the order of 0.5 mm and the rail discontinuity at the hinge junction, where the compressibility is advantageously much smaller (about one order of magnitude smaller). Such a solution aids in preventing a too high stress concentration in the rail at the intermediate location 17, caused by the sudden transition from a resilient pad to a rigid pad (steel or cast epoxy) underneath the rail.

The varying resiliency can be obtained by varying the resiliency of the resilient member 16 along its length, which in turn can be obtained through varying the physical properties of the material of the resilient member 16 between the intermediate location 17 and the rail end 11, such as by providing different hardness values of the material. To this end, the resilient region between the intermediate location 17 and the rail end 11 can be divided in different sections, typically two to three. Referring to FIG. 2, the resilient region is divided in three sections 21-23, in which the resilient member 16 has different physical properties. Advantageously, rubber materials having different hardness can be used to form the resilient member 16 in the different sections. By way of example, a rubber material having a Shore A or IRHD of about 50 can be used in section 21, one having Shore A or IRHD of about 70 can be used in section 22, and one having Shore A or IRHD of about 90 can be used in section 23. Advantageously, the cross section of the resilient member 16 is identical in all three sections 21-23, which eases manufacturing. Alternatively, or in addition, the varying resiliency can be obtained by varying the geometry (cross section) of the resilient member 16. The latter solution is however more costly.

It will be convenient to note that due to the U-shape, the resilient material of member 16 at the bottom 192 of recess 191 is more or less trapped between the lower and upper web members 19 and 20 respectively. As it is known that rubber materials show an almost infinite stiffness when they are prevented to expand, this is also the case for the horizontal section of the resilient member 16 extending over the bottom 192 of recess 191. Therefore, due to the geometry as shown, the resilient member 16 can show a substantial stiffness in vertical direction, preventing an excessive sinking of the rail head 13 in the resilient member 16.

Figure 8:
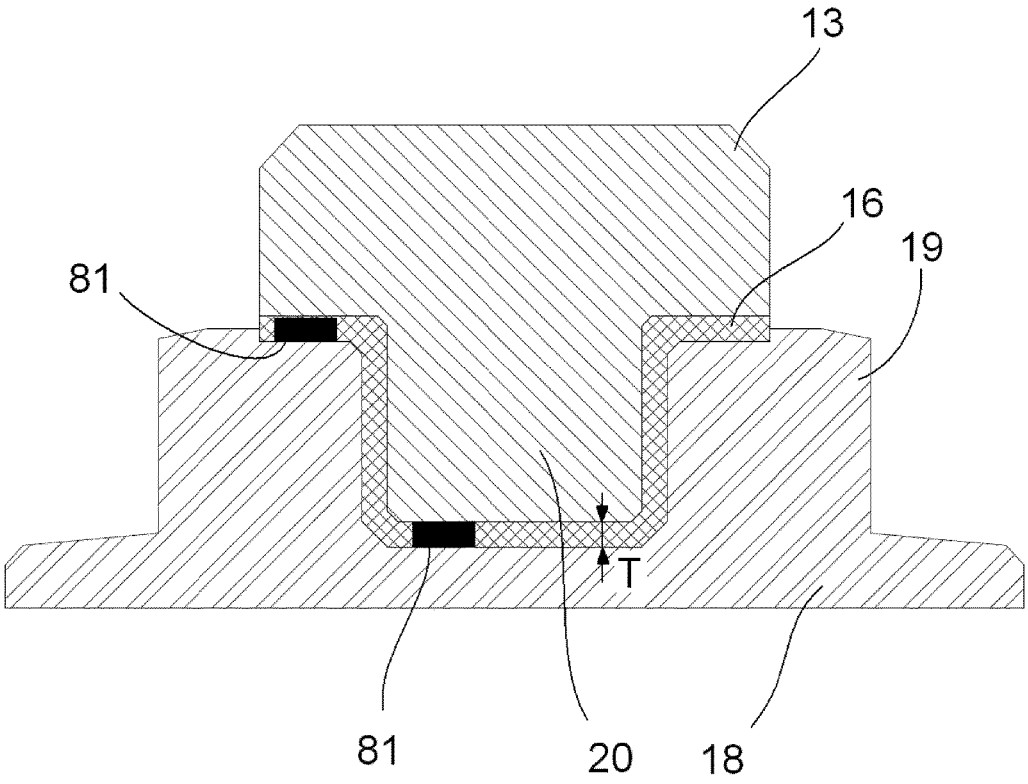
FIG. 8 represents a cross sectional view of a rail according to an aspect of the invention.

Referring to FIG. 8, as a safety measure, and possibly in order to limit the maximal vertical deformation of the rail head 13 relative to the rail foot part 18 at the rail discontinuity of the hinge junction (end 11 of FIG. 5), advantageously metal shims 81 are provided between the lower and upper web members 19, 20 respectively. Shims 81 form an abutment for the rail head 13 and upper web member 20, and have a thickness which is advantageously smaller than the distance T between the lower and upper web members (thickness of the resilient member 16), such that they advantageously project partially through the resilient member 16. Shims 81 are advantageously spaced apart from the rail head part 13, 20 by the resilient member 16, which forms a thin strip of a few tenths of a millimeter at the corresponding location. Shims 81 are provided at or in proximity of the rail end 11, and advantageously have limited longitudinal extension, in any case shorter than the resilient member 16, advantageously a length smaller than or equal to 100 mm.

Figure 9:
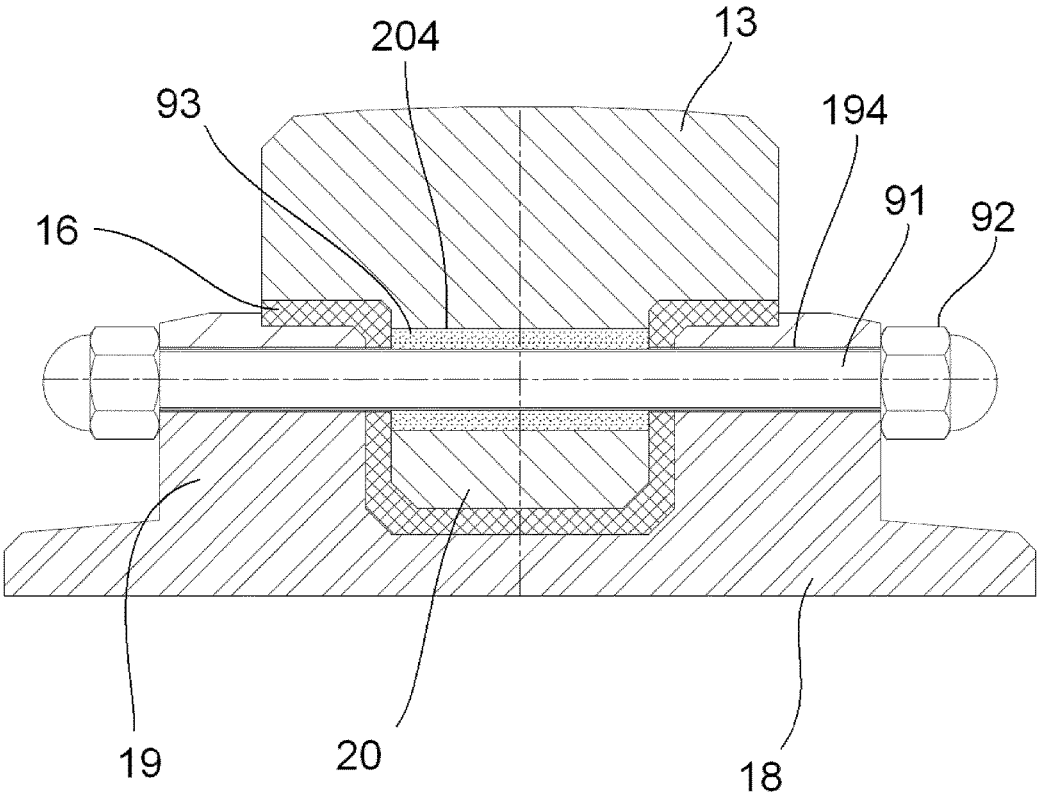
FIG. 9 represents a cross sectional view of a rail according to an aspect of the invention.

Referring to FIG. 9, a mechanical securement between the rail head part 13, 20 and the rail foot part 18, 19 can be provided in the resilient region as a safety measure in case of failure of adherence of the resilient member 16 to the upper and lower web members 19, 20. Mechanical securement can be effected by inserting a threaded rod 91, which can alternatively be a bolt or other type of removable fastener, transversely through the rail, thereby engaging the lower web member 19 and the upper web member 20 in respective transverse through holes 194 and 204. The threaded rod 91 is secured by nuts 92 at both sides of the rail. A resilient sleeve 93, advantageously made of a rubber material, can be provided around the rod 91 in the upper web member's through hole 204. Such safety rods 91 can be provided at a few locations along the resilient region 11-17 of the rail.

Figure 10:
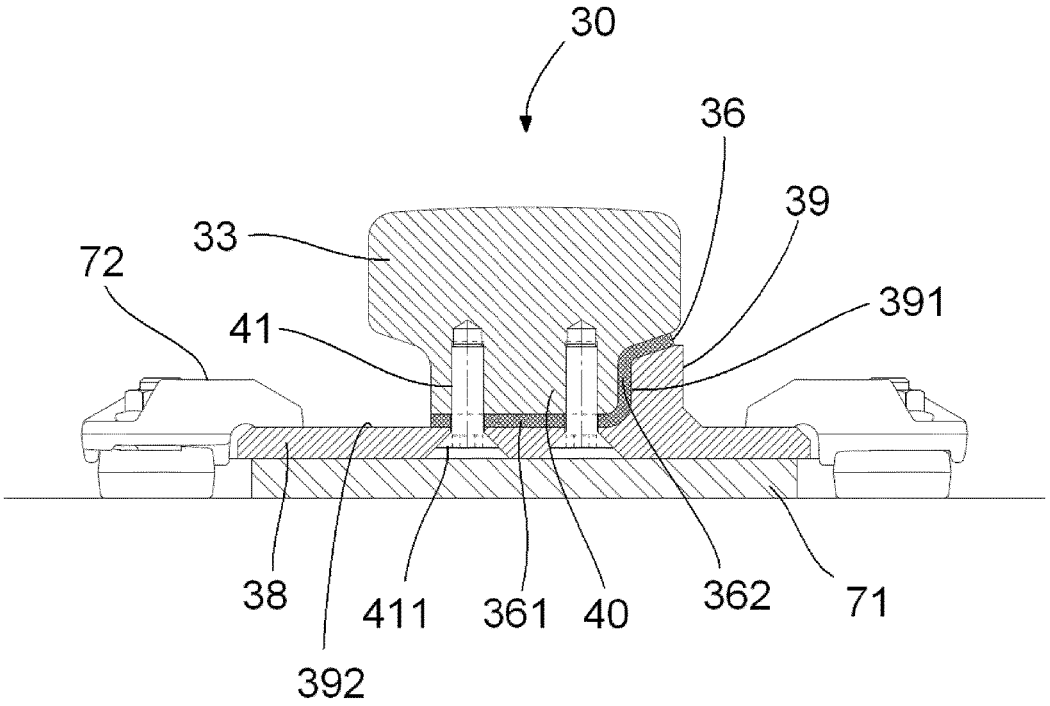
FIG. 10 represents a cross sectional view of yet another rail according to the invention.

The resilient members 16 described hitherto are symmetrical with regard to a vertical median plane 21 of the rail. This provides the advantage that a same rail can be used at both sides of the hinge junction. Although less common in industrial situations, aspects of the invention encompass rails having a resilient member which is nonsymmetrical with regard to the rail's vertical median plane. An example nonsymmetrical resilient member is shown in FIG. 10. Rail 30 differs from rail 10 in that the resilient member 36 is not formed with a U-shaped cross section. Instead, resilient member 36 comprises a substantially horizontal bottom part 361, and a part 362 extending substantially upright. Needless to say, both parts 361 and 362 extend longitudinally along the resilient region. In this regard, the lower web member 39 comprises a surface 392 supporting the bottom part 361 of the resilient member 36, and an upwards projecting abutment 391 for the upper web member 40 and the upright part 362 of the resilient member. Whereas the lower web member 19 of FIG. 2 comprises a pair of upwardly projecting abutments (walls 193) arranged at opposite sides of the upper web member 20, the lower web member 39 of rail 30 is provided with an abutment 391 at one side of the upper web member 40 only. Screws 41 can extend from the rail foot 38, through the resilient member 36, into the rail head part 33 in order to provide for mechanical securement of the rail head 33 to the foot 38. Screws 41 are threaded in the body of the rail head 33 only, the screw heads 411 being free to move downward. As a result, a downwards movement of rail head 33 relative to the rail foot is allowed. By advantageously making the through-passage of the screws in rail foot 38 larger than the size of the screw, a lateral resiliency is obtained. Alternatively, or in addition, it is possible to cover the screw 41 with a rubber sleeve where it passes through the rail foot 38. Such a rail 30 is able to take up lateral forces in one direction only (to the right of FIG. 10). Use of such a nonsymmetrical rail can be contemplated in cases where the rail profile at the junction is nonsymmetrical. It will be convenient to note that is possible to combine symmetrical and nonsymmetrical sections of the resilient member in a single rail.

Even though aspects of the invention have been ascribed beneficial to crane rails, it will be convenient to note that the invention can be used with benefit at any other kind of rail discontinuity, such as thermal expansion discontinuities of rails, and for other applications, such as transportation railways, in particular high speed transportation.

The invention claimed is:

1. A rail for use at a rail discontinuity, the rail extending longitudinally from one end to an opposite end, and comprising a rail head having a running surface for a wheel of a railway vehicle, a rail foot for fastening the rail head, and a web connecting the rail head to the rail foot and interposed between the rail head and the rail foot, wherein the rail head is continuous along the length of the rail, wherein the rail comprises a resilient member extending across the web and extending from the one end of the rail over a length shorter than the length of the rail in order to provide a resiliency of the rail head relative to the rail foot over a length of extension of the resilient member; and wherein over the length of the extension of the resilient member, the web comprises a lower part fixed to or integral with the rail foot and an upper part fixed to or integral with the rail head, wherein the upper part and the lower part have opposite facing surfaces which are spaced apart, and wherein the resilient member is interposed between the opposite facing surfaces.

2. The rail of claim 1, wherein the rail head, the rail foot and the web are rigidly connected at the opposite end of the rail.

3. The rail of claim 1, wherein the resilient member makes the rail head resilient relative to the rail foot in a horizontal transverse direction and in a vertical direction.

4. The rail of claim 1, wherein, over the length of extension of the resilient member, the web comprises a lower part fixed to or integral with the rail foot and an upper part fixed to or integral with the rail head, wherein the lower part comprises a support surface and at least one abutment projecting upwards from the support surface, and the upper part comprises a downward projection extending between the support surface and the at least one abutment, wherein the resilient member extends between the bottom surface and the projection and between the at least one abutment and the projection.

5. The rail of claim 1, wherein, over the length of extension of the resilient member, the web comprises a lower part fixed to or integral with the rail foot and an upper part fixed to or integral with the rail head, wherein the lower part comprises a recess and the upper part comprises a corresponding projection extending in the recess, wherein the resilient member extends between the recess and the projection, and wherein the resilient member makes contact with a bottom of the recess and one or more side walls of the recess and with a bottom of the projection and one or more side walls of the projection.

6. The rail of claim 1, wherein the resilient member has a substantially U-shaped cross section.

7. The rail of claim 1, wherein the rail foot extending underneath the resilient member is not continuous with the remainder of the rail foot.

8. The rail of claim 1, wherein the rail head has a resiliency relative to the rail foot over the length of extension of the resilient member, which resiliency decreases towards the one end of the rail.

9. The rail of claim 8, wherein the resilient member has increasing stiffness towards the one end of the rail.

10. The rail of claim 9, wherein the resilient member comprises sections having different stiffness.

11. The rail of claim 8, wherein the resilient member has substantially equal cross section along the length of extension of the resilient member.

12. The rail of claim 1, wherein the resilient member is made of a rubber.

13. The rail assembly comprising a rail according to claim 1, a resilient pad arranged underneath the rail foot, and clamps fastening the rail, wherein the resilient pad extends from the opposite end over a length shorter than the length of the rail, and wherein the rail foot rests on a rigid support beyond the resilient pad.

14. The rail assembly of claim 13, wherein the resilient pad extends underneath the rail until an intermediate location between the one rail end and the opposite end, and wherein the resilient member extends from the one end until substantially the intermediate location.

15. A crane comprising a frame, a girder fixed to the frame, and a boom pivotally arranged at an end of the girder, wherein the girder and the boom are provided with a railway track along which a railway vehicle is arranged to run, wherein at facing ends of the girder and the boom, the railway track comprises a rail assembly according to claim 13.

16. The crane of claim 15, wherein the resilient pad extends underneath the rail until an intermediate location between the one rail end and the opposite end, and wherein the resilient member extends from the one end until substantially the intermediate location.

17. The rail assembly of claim 13, wherein the rigid support is a steel or cast epoxy support.

18. A rail for use at a rail discontinuity, the rail extending longitudinally from one end to an opposite end, and comprising a rail head having a running surface for a wheel of a railway vehicle, a rail foot for fastening the rail head, and a web connecting the rail head to the rail foot and interposed between the rail head and the rail foot, wherein the rail head is continuous along the length of the rail;

wherein the rail comprises a resilient member extending across the web and extending from the one end of the rail over a length shorter than the length of the rail in order to provide a resiliency of the rail head relative to the rail foot over a length of extension of the resilient member; and wherein the rail head and a portion of the rail foot are separate independent components from one another;

a gap between the rail head and the rail foot formed opposite facing surfaces that are vertically spaced apart from one another forming a complete vertical discontinuity between the rail head and the portion of the rail foot, the resilient member being positioned within the gap and vertically separating the portion of the rail foot from the rail head.

19. The rail of claim 18, wherein a portion of the web is formed as a continuous piece of material with the rail head and a portion of the web is formed as a continuous piece of material with the portion of the rail foot;

the portion of the web unitary with the rail head providing one of the opposite facing surfaces;

the portion of the web unitary with the rail foot providing the other of the opposite facing surfaces; and at least one location along the length of the portion of the rail foot, the gap forms a complete vertical discontinuity between the material forming the rail head and the material forming the portion of the rail foot such that all loading transferred from the rail head to the portion of the rail foot at that location along the length of the portion of the rail foot is transferred by the resilient member from the rail head to the portion of the rail foot.

20. A rail for use at a rail discontinuity, the rail extending longitudinally from one end to an opposite end, and comprising a rail head having a running surface for a wheel of a railway vehicle, a rail foot for fastening the rail head, and a web connecting the rail head to the rail foot and interposed between the rail head and the rail foot, wherein the rail head is continuous along the length of the rail;

wherein the rail comprises a resilient member extending across the web and extending from the one end of the rail over a length shorter than the length of the rail in order to provide a resiliency of the rail head relative to the rail foot over a length of extension of the resilient member; and wherein at least one axial location along the length of the resilient member, the rail head and the rail foot are completely vertically separated from one another forming a vertical gap therebetween extending laterally across the web, the resilient member being positioned within the gap therebetween to completely vertically offset the rail head from the rail foot at that at least one axial location.

* * * * *